US008378270B2

(12) United States Patent
Martin et al.

(10) Patent No.: US 8,378,270 B2
(45) Date of Patent: Feb. 19, 2013

(54) CERAMIC HOB

(75) Inventors: Bernd Martin, St. Georgen (DE); Markus Schlegel, Bretten (DE); Thomas Stein, Taufkirchen/Vils (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 369 days.

(21) Appl. No.: 12/741,830

(22) PCT Filed: Oct. 27, 2008

(86) PCT No.: PCT/EP2008/064516

§ 371 (c)(1), (2), (4) Date: May 7, 2010

(87) PCT Pub. No.: WO2009/065703

PCT Pub. Date: May 28, 2009

(65) Prior Publication Data

US 2010/0243636 A1 Sep. 30, 2010

(30) Foreign Application Priority Data

Nov. 20, 2007 (DE) ..... 10 2007 055 310

(51) Int. Cl.
*H05B 3/68* (2006.01)

(52) U.S. Cl. ..... 219/445.1; 219/444.1; 219/443.1

(58) Field of Classification Search ..... 219/443.1, 219/444.1, 445.1, 522
See application file for complete search history.

(56) References Cited

U.S. PATENT DOCUMENTS

| | | | | |
|---|---|---|---|---|
| 5,717,189 | A | 2/1998 | Goetz et al. | |
| 2006/0081753 | A1 | 4/2006 | Winkler | |
| 2007/0108184 | A1 * | 5/2007 | Imamoto et al. | 219/441 |
| 2007/0114227 | A1 * | 5/2007 | Stumpf et al. | 219/633 |

FOREIGN PATENT DOCUMENTS

| | | | |
|---|---|---|---|
| DE | 19740424 | A1 | 3/1999 |
| DE | 102004004778 | A1 | 9/2005 |
| DE | 102005008901 | A1 | 8/2006 |
| DE | 102005040884 | A1 | 3/2007 |
| EP | 1139695 | A2 | 10/2001 |
| FR | 2895047 | A1 | 6/2007 |
| WO | 2007077153 | A2 | 7/2007 |

* cited by examiner

*Primary Examiner* — Angel Roman
(74) *Attorney, Agent, or Firm* — James E. Howard; Andre Pallapies

(57) ABSTRACT

A ceramic hob includes a cooking surface for positioning a cooking pot, a housing, an electronic circuit carrier mounted in the housing beneath the cooking surface, and a positioning element on a lower side of the cooking element engaging a recess of the electronic circuit carrier.

20 Claims, 3 Drawing Sheets

CERAMIC HOB

BACKGROUND OF THE INVENTION

The invention relates to a ceramic hob comprising a cooking surface for positioning a cooking pot, and an electronic circuit carrier arranged beneath the cooking surface.

Ceramic hobs which have a cooking surface and are made from glass ceramic are known from the prior art. Cooking pots such as pots, pans etc. are placed on this cooking surface, with, to this end, heatable cooking zones being provided on the cooking surface. Furthermore, a known ceramic hob of this type also comprises electronics, by way of which operating parameters of the ceramic hob can be adjusted and monitored. Circuit carriers of this type can comprise light sources, which illuminate the ceramic hob from below and as a result enable the representation of different displays, such as for instance operating parameter values or suchlike, on the upper side of the ceramic hob, With these known ceramic hobs, it is disadvantageous that display can often take place in an inaccurate and unclear fashion, if the illumination is not guaranteed as a result of the inaccurate positioning of the circuit carrier relative to the ceramic hob.

The electronics and/or circuit carriers were previously mostly positioned indirectly above their own housing. The circuit carriers are fixedly arranged herein, as a result of which positioning inaccuracies result from the entirety of all individual components due to the positioning tolerance, it being possible for said positioning inaccuracies to only very inadequately meet the requirements of the displays.

In this context, tolerances can occur as a result of length tolerances of the glass ceramic, adhesive tolerance of the assembly frame relative to the glass ceramic, centering tolerances from the housing relative to the assembly frame, length tolerances of the electronic housing, fastening tolerances of the electronics in the housing and the positioning accuracy of the electronics module on the printed circuit board and/or the circuit carrier. In this context, total tolerances can develop in the millimeter range, as a result of which considerable inaccuracies in respect of the illumination and/or displays may result.

BRIEF SUMMARY OF THE INVENTION

It is the object of the present invention to create a ceramic hob, in which these tolerances can at least be significantly reduced and the display inaccuracies can be improved.

An inventive ceramic hob includes a cooking surface which is embodied for positioning a cooking pot and an electronic circuit carrier arranged below the cooking surface. At least one positioning element is arranged on the lower side of the cooking surface, said positioning element engaging in a recess in the circuit carrier which is mounted in a housing in a movable manner. An embodiment of this type enables the position fixing of the circuit carrier and the cooking surface and tolerances can be balanced out as a result. The desired position between the circuit carrier and the cooking surface can also be very accurately ensured, including in respect of an improved display of information. This position fixing can, not least also be enabled permanently.

By the circuit carrier also being mounted in the housing in a mobile manner, additional tolerances can be easily and economically balanced out. In particular, the "floating" bearing of the circuit carrier in the housing also ensures the possibility of additional balancing movements of the circuit carrier, so that tolerances can also be easily compensated afterwards.

The moveable bearing of the circuit carrier in the housing can preferably be enabled both in a horizontal plane and also in a direction at right angles to this horizontal plane. This high degree of flexibility in respect of the floating bearing enables a particularly accurate position adjustment and ensures this long-term.

The ceramic hob preferably includes at least two positioning elements, which are arranged on the lower side of the cooking surface. This plurality enables the position fixing to be improved still further, since a position fixing in a plane can be ensured.

The circuit carrier preferably comprises at least one display and/or a light source and is arranged below a display surface assigned to the cooking surface. In this context, the circuit carrier can also include a seven segment display and suchlike for instance. The pattern generated by the circuit carrier and/or the display and/or light unit can then be displayed through the display surface via translucent areas embodied specifically in the display surface.

The display surface is preferably a separate part, which is connected, in particular by means of adhesive, to the second part of the cooking surface which is embodied from glass ceramic. The display surface is thus embodied from a specific material, which ensures a particularly suitable property in respect of the optical transparency and thus also in respect of a flexible and versatile representation of information.

The display surface is embodied in particular from a material which differs from the glass ceramic material of the second part of the cooking surface which is preferably provided. In particular, in respect of its optical properties, the material of the display surface can enable the permeability of light beams in a spectral range which is not possible through the material of the glass ceramic.

The shape of the display surface is preferably adjusted to the shape of the circuit carrier and/or the dimensions of the display surface are larger than or equal to the dimensions of the circuit carrier. An embodiment of this type can create an effectively separate module which is centered in the ceramic hob, which is designed to be compact where space and installation space requirements are harmonized. Also in this respect, the suitable embodiment can then be enabled in respect of the displays to be provided. In this respect, the relative positioning of the circuit carrier and the display surface can also be suitably tailored to one another.

The positioning element is preferably fixed with adhesive to the lower side of the cooking surface, in particular the display surface.

Provision can also be made for the cooking surface and the positioning element to be embodied in one piece. As a result, the manufacturing method can take place more rapidly and the attachment of the positioning elements can be enabled very exactly. Assembly tolerances of the positioning elements can be reduced as a result.

The cooking surface and the positioning element can be embodied from different materials. Suitable materials combinations can also be selected here in respect of the requirements in terms of mechanical rigidity and thermal stability.

The cooking surface, in particular the lower side of the display surface, is preferably imprinted with at least one symbol and/or scale. It is particularly advantageous with an embodiment of this type for the exact positioning of the circuit carrier, relative to the cooking surface, in particular to the display surface, to be ensurable by the positioning elements and their engagement in the recess. The optically exact display and illumination of the symbols and/or scale can be achieved very precisely as a result.

The recess is preferably embodied in the circuit carrier as a continuous hole. As a result, a particularly effective engagement and a particularly suitable position fixing can be ensured. Unwanted slippage or shifting can be prevented as a result.

However, a recess can naturally also be embodied as a blind hole and thus as a non-continuous hole or as a simple impression or suchlike.

The inventive ceramic hob can at least reduce, in particular eliminate, the tolerance chain of the individual positionings and/or dimensions, and a direct positioning of electronic components relative to the preferably embodied impression of the display surface can be achieved. By means of this embodiment, the positioning accuracy can be reduced to a few 10ths of a millimeter, as a result of which it is at least five to ten times more accurate than arrangements which are known from the prior art. As the housing of the circuit carrier no longer has to ensure positioning in a horizontal plane, it can be optimized in terms of fastening in a vertical direction and/or in terms of its sealing function.

BRIEF DESCRIPTION OF THE DRAWINGS

An exemplary embodiment of the invention is described in more detail below with reference to schematic drawings, in which.

DETAILED DESCRIPTION OF EXEMPLARY EMBODIMENTS OF THE PRESENT INVENTION

Figure 1:
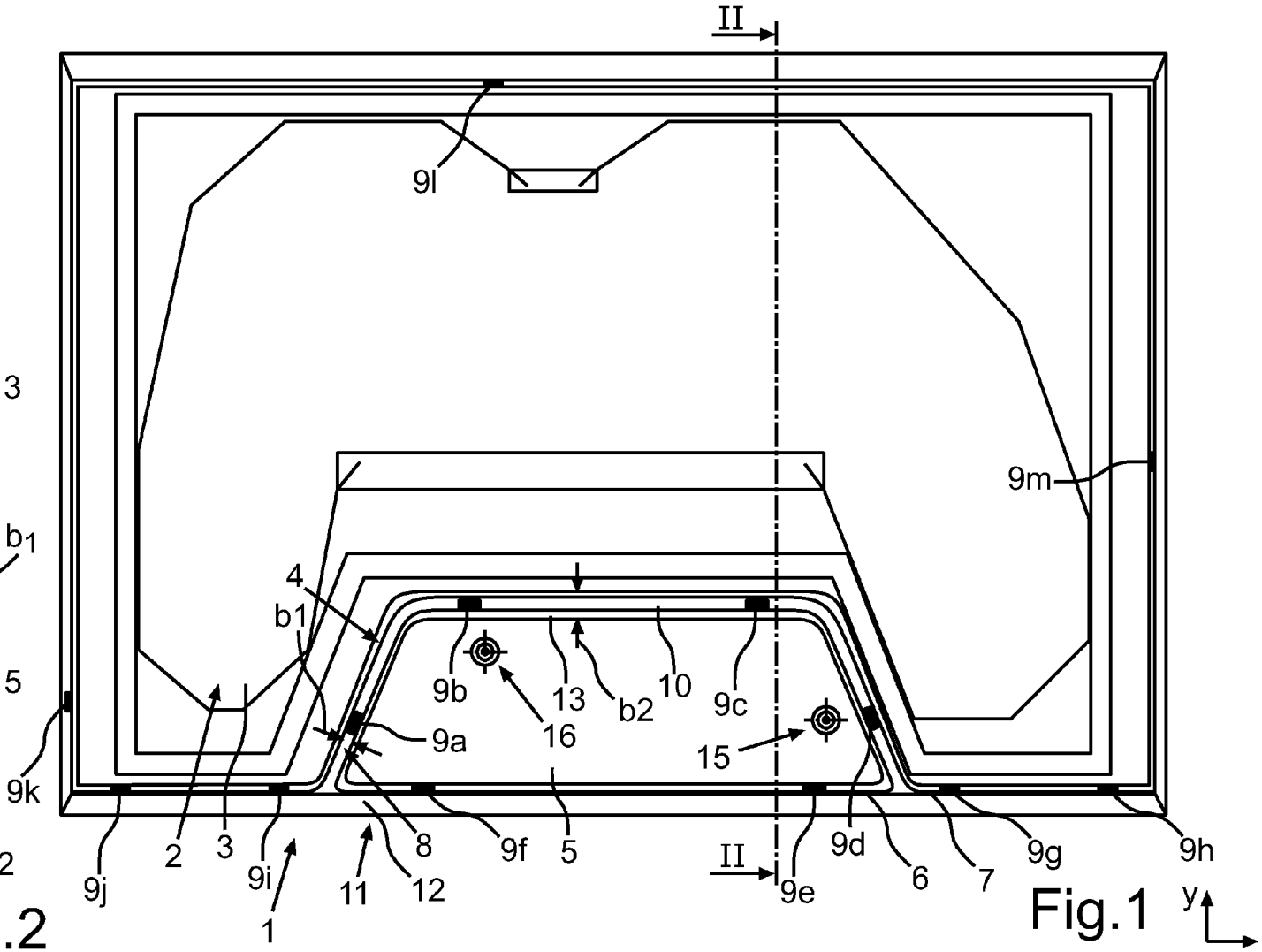
FIG. 1 shows a top view onto a ceramic hob.

The same or functionally-identical elements are provided with the same reference characters in the Figures.

FIG. 1 shows a top view of a ceramic hob 1, which has a cooking surface 2 made of glass ceramic 3. A cooking pot, for instance a pot or a pan or suchlike, can be positioned and/or placed on this glass ceramic 3. The cooking surface 2 includes at least one cooking zone (not shown in further detail), which comprises a heating facility.

A peripheral section 4 is embodied in the x-direction centrally in the glass ceramic 3 on the front end 7 of the glass ceramic 3 and thus also of the ceramic hob 1. In the composite state of the ceramic hob 1 as shown in FIG. 1, an insert is arranged in this section 4, which is embodied from a material which differs by comparison with the glass ceramic 3. In particular, this distinction of the material is designed in respect of the different optical properties of the glass ceramic 3 and the insert 5. In the exemplary embodiment, the section 4 and also the insert 5 are embodied in the manner of a trapezoid, with a front edge 6 of the insert 5 being arranged flush with the front edge 7 of the glass ceramic 3. The insert 5 thus does not extend beyond the front edge 7 of the glass ceramic, as a result of which a space-saving embodiment of the ceramic hob 1 is achieved. By the insert 5 nevertheless being positioned as far to the outside as possible and thus in the peripheral section 4, the other cooking surface 2 is not restricted in terms of its dimensions and the functionality in particular also in respect of the dimensioning and arrangement of the cooking zones is thus not negatively affected by the position of the insert 5.

In the exemplary embodiment, the insert 5 is embodied from grey glass and is inter alia permeable, in particular translucent, for light in the blue spectral range. Furthermore, the insert 5 is also permeable for light in the red and yellow spectral range. The representation of different colors is enabled by this embodiment, as a result of which different adjustments, different operations and different displays can be specified using color. This distinguishing feature thus enables the user of the ceramic hob 1 to also perceive and distinguish between the displays of different information more quickly and with more accuracy. As the material of the glass ceramic 3 absorbs the light of the blue spectral range, the functionality of the cooking field and in particular of the display and/or control area of the ceramic hob 1 can be considerably improved by means of the insert 5. The insert 5 specifies the display and/or control area of the ceramic hob 1. To this end, one or several light sources, in particular light-emitting diodes, are arranged below the insert 5. A printed circuit board, which has the control electronics, is likewise arranged below the insert 5.

The insert 5 is arranged at a distance and in a contact-free fashion from the glass ceramic 3 in section 4. A gap 8 embodied between the insert 5 and the glass ceramic 3 has a width b1, which amounts to approximately 4 mm in the exemplary embodiment.

The insert 5 is connected to the glass ceramic 3 in section 4 by means of two different adhesives. Provision is made on the one hand for a fastening to be provided by means of a UV adhesive embodied in the manner of points, with a silicon adhesive also being provided on the other hand. This is embodied in the manner of a string and extends beyond the whole length of the section 4 between the glass ceramic 3 and the insert 5. The UV adhesive is only realized by the adhesive points 9*a*, 9*b*, 9*c* and 9*d*.

Furthermore, this UV adhesive is also provided to fasten a decorative frame to the periphery of the glass ceramic 3 and the insert 5, with adhesive points 9*e*, 9*f*, 9*g*, 9*h*, 9*j*, 9*k*, 9*l* and 9*m* being identified in this respect. Both the location of these adhesive points 9*e* to 9*m* and also the number of adhesive points on each of the edge sides of the periphery are only exemplary. Several adhesive points of this type are preferably embodied on each of the edge sides on the periphery.

Aside from the decorative frame 11, the ceramic hob 1 also includes an assembly frame 14 (FIG. 2) which is connected to the decorative frame 13, in particular to the decorative frame 12 on the periphery. The glass ceramic 3 and the insert 5 are arranged and/or clamped and held in a positionally-stable fashion between the decorative frame 11 and the assembly frame 14.

In the exemplary embodiment, two centering elements 15 and 16 are arranged on the rear of the insert 5, which extend downwards in the manner of a pin. The centering elements 15 and 16 engage into recesses of the downwardly arranged printed circuit board of the control electronics system when the ceramic hob 1 is in the assembled state, as a result of which an exact positioning is achieved between the insert 5 and the display unit and/or the light sources. As a result, the light emitted by the light sources and the display unit can very accurately pass through the insert 5 at the desired specific positions, and position-specific back-lighting can be ensured.

Figure 2:
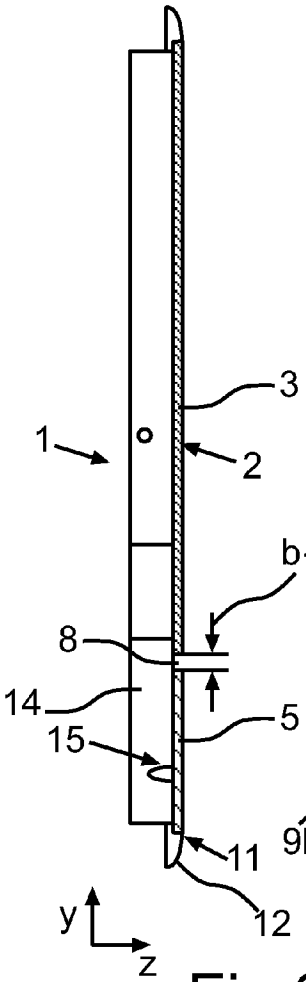
FIG. 2 shows a sectional representation of the ceramic hob according to FIG. 1.

FIG. 2 shows a sectional representation along the line of intersection II-II of the ceramic hob 1 according to FIG. 1. The centering element 15 which tapers downwards like centering element 16 is shown. In the representation according to FIG. 2, for reasons of clarity, the decorative frame 13 above the gap 8 is not shown. As shown in the representation according to FIG. 2, the insert 5 has the same thickness (extension in the z-direction) as the glass ceramic 3.

Figure 3:
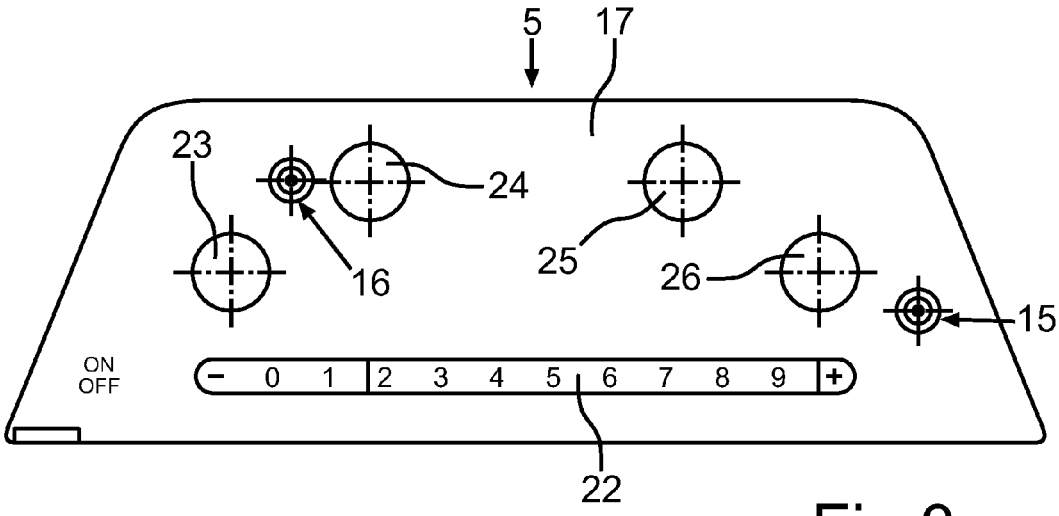
FIG. 3 shows an enlarged representation of a top view of the insert of the ceramic hob in accordance with FIG. 1.
Figure 4:
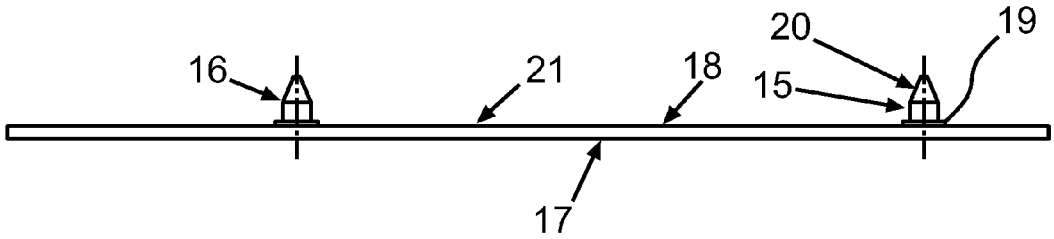
FIG. 4 shows a side view of the insert according to FIG. 3.

FIG. 3 shows a top view onto the insert 5. A scale 22 and regions 23, 24, 25 and 26 are shown on the front side in order to illustrate symbols. Both the scale 22 and also the regions 23 to 26 are arranged, in particular pressed, onto a rear 18 of the insert 5 which is shown in FIG. 4. The scale 22 and the regions 23 to 26 are imprinted in a white color, which is no longer pure white when observed from the upper side as a result of the embodiment of the insert 5 as gray glass. Furthermore, the permeability of the light in the blue spectral range is not negatively affected by the scale 22 and the regions 23 and 26.

FIG. 4 shows a side view of the insert 5 according to the representation in FIG. 3. In addition to the impression with the scale 22 and the regions 23 to 26 on the remaining surface, a black overlay 21 is attached to the rear 18, which can be realized as a film or in particular as an imprint. This overlay 21 does not negatively affect the permeability of the light of the blue spectral range.

The centering element 15 comprises an adhesive surface 19, with which a fastening to corresponding components of the ceramic hob 1 is enabled. Furthermore, the tip 20 of the centering element 15 engages in the mentioned recess in the printed circuit board arranged below the insert 5. The centering element 16 is embodied similarly.

To manufacture the ceramic hob 1 in accordance with the representation in FIG. 1, the decorative frame 12, 13 is initially rotated and the upper side therefore rests downwards facing an assembly apparatus. The glass ceramic 3 already provided with the section 4 is then likewise rotated and inserted into this decorative frame 12, 13 with its upper side shown in FIG. 1 facing downward. A movement is correspondingly effected with the introduction of the insert 5 into the decorative frame 12, 13, so that the upper side and/or front side 17 is then arranged here pointing downwards. In a subsequent manufacturing step, the UV adhesive is then introduced in a punctiform manner, as is shown by way of example on the corresponding adhesive points 9*a* to 9*m*. In particular, several adhesive points are arranged on each side of the peripheral sides. After curing the UV adhesive, the silicon adhesive 10 is then introduced in the gap 8 as a string. The imprint of the insert 5 on the rear 18 with the regions 23 to 26, the scale 22 and the black overlay 21 is already implemented prior to inserting the insert 5 into the rotated decorative frame 12, 13. The insert 5 is connected to the decorative frame 12, 13 and the glass ceramic 3 by means of the UV adhesive and the silicon adhesive 10.

Subsequently, the assembly frame 14 is itself then mounted. Further or preceding method steps are less important to the invention and are not mentioned in further detail here, since they essentially represent known method steps.

Furthermore, mention is made of it being possible to realize the connection between the insert 5 and the glass ceramic 3 in another way. The adhesive connection can thus also be replaced by another connection type or if necessary supplemented.

Figure 5:
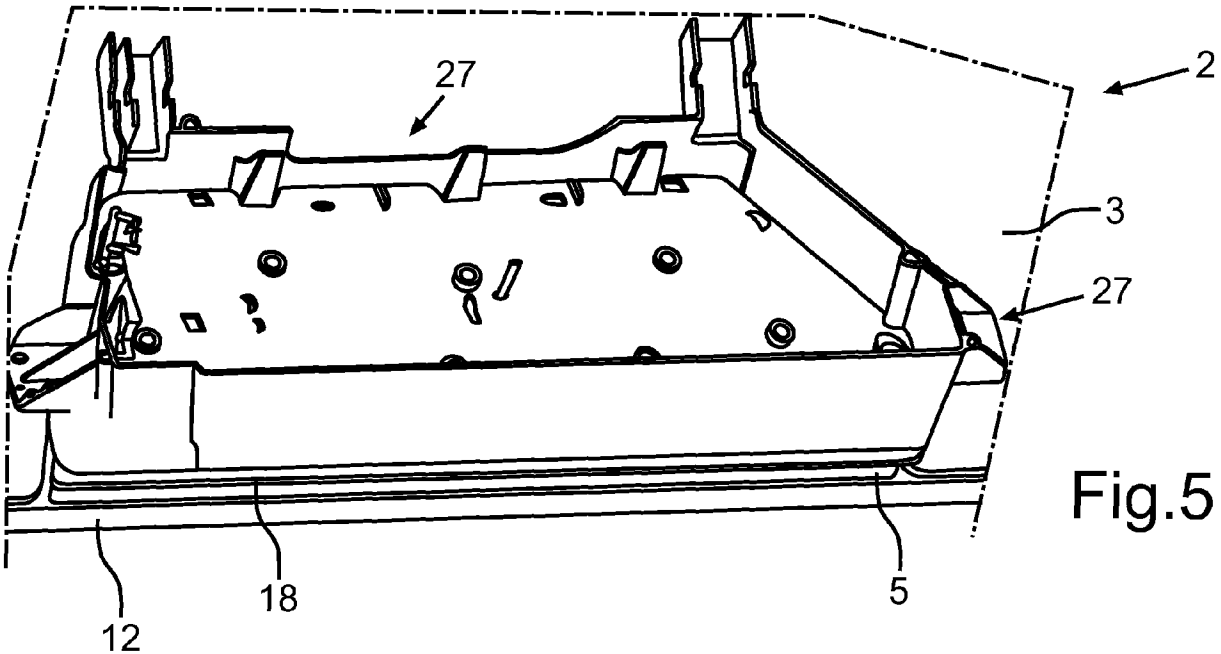
FIG. 5 shows a first view of the ceramic hob from below.
Figure 6:
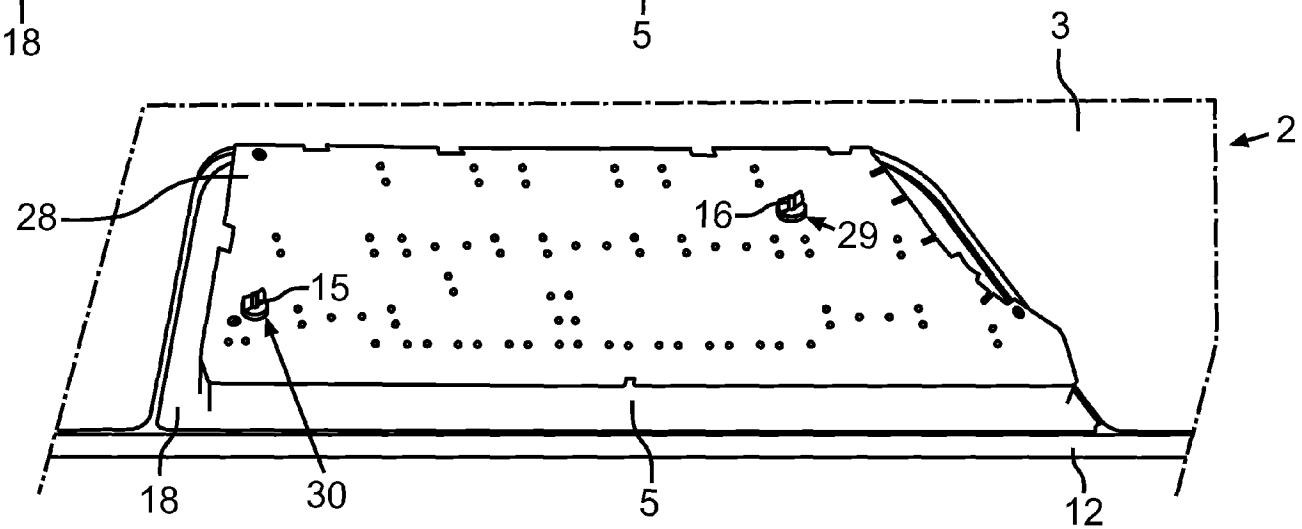
FIG. 6 shows a second view of the ceramic hob from below.

FIG. 5 shows a perspective representation of a view from below of a subsection of the ceramic hob 1. A housing 27 is arranged on the lower side of the insert 5, which is embodied so as to receive a circuit carrier 28 (FIG. 6). The circuit carrier 28 represents the printed circuit board of the control electronics and includes at least one display and/or a light source. The housing 27 is preferably made of plastic and can be fastened directly to the lower side and/or rear 18 of the insert 5. Provision can however also be made for an arrangement at a distance relative to the rear side 18, and for the fastening of the housing 27 to other components of the ceramic hob.

In the embodiment according to FIG. 5, the housing 27 has a molding, which essentially corresponds to the trapezoidal molding of the insert 5. The dimensions of the housing 27 are also essentially dimensioned such that they correspond to the dimensions of the insert 5.

FIG. 6 shows a further perspective representation of a subsection of the ceramic hob 1 with the arrangement of the circuit carrier 28 being shown on the lower side and/or rear 18 of the insert 5. The circuit carrier 28 includes two continuous holes 29 and 30 as recesses, through which the centering elements and/or positioning elements 15 and 16 extend. For the purpose of clarity, FIG. 6 does not show the housing 27. The circuit carrier 28 is moveably mounted in the housing 27. This means that the circuit carrier 28 can implement balancing movements relative to the housing 27, in order, in this respect, to be able to correct further manufacturing tolerances. To realize a movability of this type and thus "floating" bearing of the circuit carrier 28 in the housing 27, elastic spring elements or elastic locking elements can be provided, in which corresponding recesses of the circuit carrier 28 can engage or lock and thus on the one hand ensure the secure holding and on the other hand enable this relative movability.

In the exemplary embodiment shown in accordance with FIG. 6, the circuit carrier 28 comprises an at least similar molding as the insert 5 and is also dimensioned in terms of its dimensions such that it does not exceed the dimensions of the insert 5. The insert 5 and the glass ceramic 3 together form the cooking surface 2, with the insert 5 effectively representing the display surface.

The invention claimed is:

1. A ceramic hob comprising:

a cooking surface for supporting a cooking pot;

an insert which is a part of the cooking surface, the insert having a display area;

a housing positioned beneath the insert;

an electronic circuit carrier mounted in the housing and beneath the insert such that movement of the electronic circuit carrier is unrestrained by the housing in a first direction; and a positioning element attached to a lower side of the insert, the positioning element engaging a recess of the electronic circuit carrier, wherein the first direction is substantially parallel to the cooking surface.

2. The ceramic hob of claim 1, wherein the positioning element comprises two positioning elements on the lower side.

3. The ceramic hob of claim 1, wherein the circuit carrier comprises a display and/or a light source that is below the display area of the insert.

4. The ceramic hob of claim 3, wherein the insert is glued to a second part of the cooking surface embodied from glass ceramic.

5. The ceramic hob of claim 3, wherein a shape of a perimeter of the insert is substantially identical to a shape of a perimeter of the circuit carrier and the perimeter of the insert is greater than or equal to the perimeter of the circuit carrier.

6. The ceramic hob of claim 1, wherein the positioning element is fixed to the lower side by an adhesive.

7. The ceramic hob of claim 1, wherein the positioning element is fixed to the insert.

8. The ceramic hob of claim 1, wherein the cooking surface and the positioning element comprise different materials.

9. The ceramic hob of claim 1, wherein the lower side of the insert is imprinted with a symbol and/or a scale.

10. The ceramic hob of claim 1, wherein the recess defines a continuous hole.

11. The ceramic hob of claim 1, wherein the movement of the electronic circuit carrier is unrestrained by the housing in a second direction, the second direction being perpendicular to the first direction and parallel to the cooking surface.

12. The ceramic hob of claim 4, wherein a shape of a perimeter of the insert is substantially identical to a shape of a perimeter of the circuit carrier and the perimeter of the insert is greater than or equal to the perimeter of the circuit carrier.

13. A ceramic hob comprising:

a cooking surface for supporting a cooking pot;

an insert which is a part of the cooking surface, the insert having a display area;

a housing positioned beneath the insert;

an electronic circuit carrier mounted in the housing and beneath the insert such that the electronic circuit carrier can move relative to the housing during assembly of the ceramic hob; and a positioning element attached to a lower side of the insert, the positioning element engaging a recess of the electronic circuit carrier.

14. The ceramic hob of claim 13, wherein the positioning element comprises two positioning elements on the lower side.

15. The ceramic hob of claim 13, wherein the circuit carrier comprises a display and/or a light source that is below the display area of the insert.

16. The ceramic hob of claim 15, wherein the insert is glued to a second part of the cooking surface embodied from glass ceramic.

17. The ceramic hob of claim 16, wherein a shape of a perimeter of the insert is substantially identical to a shape of a perimeter of the circuit carrier and the perimeter of the insert is greater than or equal to the perimeter of the circuit carrier.

18. The ceramic hob of claim 15, wherein a shape of a perimeter of the insert is substantially identical to a shape of a perimeter of the circuit carrier and the perimeter of the insert is greater than or equal to the perimeter of the circuit carrier.

19. The ceramic hob of claim 13, wherein the positioning element is fixed to the lower side by an adhesive.

20. The ceramic hob of claim 13, wherein the positioning element is fixed to the insert.

* * * * *